United States Patent [19]

Hasegawa et al.

[11] Patent Number: 4,834,816

[45] Date of Patent: May 30, 1989

[54] METALLIC GLASSES HAVING A COMBINATION OF HIGH PERMEABILITY, LOW COERCIVITY, LOW AC CORE LOSS, LOW EXCITING POWER AND HIGH THERMAL STABILITY

[75] Inventors: Ryusuke Hasegawa, Morristown; Gordon E. Fish, Lake Hiawatha, both of N.J.

[73] Assignee: Allied-Signal Inc., Morris Township, Morris County, N.J.

[21] Appl. No.: 132,631

[22] Filed: Dec. 4, 1987

Related U.S. Application Data

[63] Continuation of Ser. No. 873,442, Jun. 5, 1986, abandoned, which is a continuation of Ser. No. 594,506, Mar. 29, 1984, abandoned, which is a continuation-in-part of Ser. No. 319,514, Nov. 9, 1981, abandoned, which is a continuation-in-part of Ser. No. 295,165, Aug. 21, 1981, abandoned.

[51] Int. Cl.[4] ..... H01F 1/04

[52] U.S. Cl. ..... 148/304; 148/121; 148/403

[58] Field of Search ..... 148/304, 403, 121

[56] References Cited

U.S. PATENT DOCUMENTS

| | | | |
|---|---|---|---|
| 3,856,513 | 12/1974 | Chen et al. | 75/134 F |
| 3,940,293 | 2/1976 | Polk et al. | 75/134 F |
| 3,986,867 | 10/1976 | Masumoto et al. | 75/128 F |
| 4,067,732 | 1/1978 | Ray | 75/123 J |
| 4,126,287 | 11/1978 | Mendelsohn et al. | 75/123 K |
| 4,152,144 | 5/1979 | Hasegawa et al. | 75/123 B |
| 4,152,146 | 5/1979 | Freilich et al. | 75/123 J |
| 4,190,438 | 2/1980 | Aso et al. | 75/123 K |
| 4,221,592 | 9/1981 | Ray | 75/123 K |
| 4,225,334 | 9/1980 | Inomata et al. | 75/123 B |
| 4,231,816 | 11/1980 | Cuomo et al. | 75/123 B |
| 4,255,189 | 3/1981 | Ray | 148/123 M |
| 4,298,409 | 11/1981 | DeCristofaro et al. | 148/108 |

OTHER PUBLICATIONS

Metallic Glasses–papers presented at a Seminar of the Materials Science Div. of American Soc. for Metals, Sep. 18–19, 1976, ASM, p. 31.

*Primary Examiner*—John P. Sheehan

*Attorney, Agent, or Firm*—Gus T. Hampilos

[57] ABSTRACT

Metallic glasses having high permeability, low coercivity, low ac core loss, low exciting power, and high thermal stability are disclosed. The metallic glasses are substantially completely glassy and consist essentially of about 58 to 81 atom percent iron, from 1 to about 10 atom percent of at least one member selected from the group consisting of nickel and cobalt, about 1 to 6 atom percent of at least one member selected from the group consisting of chromium, molybdenum, vanadium, niobium, and zirconium, about 11 to 27.5 atom percent boron about 0.5 to 8 atom percent silicon, 0 to about 2 atom percent carbon, plus incidental impurities, the total of born, silicon and carbon present ranging from about 17 to 28 atom percent. The alloy is heat treated at a temperature and for a time sufficient to achieve stress relief without inducing precipitation of discrete particles therein. Such a metallic glass alloy is especially suited for use in devices requiring high response to weak magnetic fields, such as ground fault interrupters and current/potential transformers.

14 Claims, 2 Drawing Sheets

METALLIC GLASSES HAVING A COMBINATION OF HIGH PERMEABILITY, LOW COERCIVITY, LOW AC CORE LOSS, LOW EXCITING POWER AND HIGH THERMAL STABILITY

This application is a continuation of application Ser. No. 873,442 filed June 5, 1986, now abandoned, which in turn is a continuation of application Ser. No. 594,506, filed Mar. 29, 1984, now abandoned, which in turn is a continuation-in-part of application Ser. No. 391,514, filed Nov. 9, 1981, now abandoned, which in turn is a continuation-in-part of application Ser. No. 295,165, filed Aug. 21, 1981, now abandoned.

BACKGROUND OF THE INVENTION

1. Field of the Invention

This invention relates to a method for enhancing the low frequency magnetic properties of metallic glasses having high permeability, low magnetostriction, low coercivity, low ac core loss, low exciting power and high thermal stability.

2. Description of the Prior Art

As is known, metallic glasses are metastable materials lacking any long range order. X-ray diffraction scans of glassy metal alloys show only a diffuse halo similar to that observed for inorganic oxide glasses.

Metallic glasses (amorphous metal alloys) have been disclosed in U.S. Pat. No. 3,856,513, issued Dec. 24, 1974 to H. S. Chen et al. These alloys include compositions having the formula $M_aY_bZ_c$, where M is a metal selected from the group consisting of iron, nickel, cobalt, vanadium and chromium, Y is an element selected from the group consisting of phosphorus, boron and carbon and Z is an element selected from the group consisting of aluminum, silicon, tin, germanium, indium, antimony and beryllium, "a" ranges from about 60 to 90 atom percent, "b" ranges from about 10 to 30 atom percent and "c" ranges from about 0.1 to 15 atom percent. Also disclosed are metallic glass wires having the formula $T_iX_j$, where T is at least one transition metal and X is an element selected from the group consisting of phosphorus, boron, carbon, aluminum, silicon, tin, germanium, indium, beryllium and antimony, "i" ranges from about 70 to 87 atom percent and "j" ranges from 13 to 30 atom percent. Such materials are conveniently prepared by rapid quenching from the melt using processing techniques that are now well-known in the art.

Metallic glasses are also disclosed in U.S. Pat. No. 4,067,732 issued Jan. 10, 1978. These glassy alloys include compositions having the formula $M_aM'_bCr_cM''_dB_e$, where M is one iron group element (iron, cobalt and nickel), M' is at least one of the two remaining iron group elements, M'' is at least one element of vanadium, manganese, molybdenum, tungsten, niobium and tantalum, B is boron, "a" ranges from about 40 to 85 atom percent, "b" ranges from 0 to about 45 atom percent, "c" and "d" both range from 0 to 20 atom percent and "e" ranges from about 15 to 25 atom percent and "e" ranges from about 15 to 25 atom percent, with the provision that "b", "c" and "d" cannot be zero simultaneously. Such glassy alloys are disclosed as having an unexpected combination of improved ultimate tensile strength, improved hardness and improved thermal stability.

These disclosures also mention unusual or unique magnetic properties for many metallic glasses which fall within the scope of the broad claims. However, metallic glasses possessing a combination of higher permeability, lower magnetostriction, lower coercivity, lower core loss, lower exciting power and higher thermal stability than prior art metallic glasses are required for specific applications such as ground fault interrupters, relay cores, transformers and the like.

SUMMARY OF THE INVENTION

The present invention provides a method of enhancing the magnetic properties of a metallic glass alloy having a combination of high permeability, low magnetostriction, low coercivity, low ac core loss, low exciting power and high thermal stability. The metallic glasses consist essentially of about 58 to 81 atom percent iron, about 1 to 10 atom percent of at least one member selected from the group consisting of nickel and cobalt, about 1 to 6 atom percent of at least one member selected from the group consisting of chromium, molybdenum, vanadium, niobium, and zirconium, about 11 to 27.5 atom percent boron, about 0.5 to 8 atom percent silicon, 0 to about 2 atom percent carbon, plus incidental impurities, the total of boron, silicon, and carbon present ranging from about 17 to 28 atom percent. The method comprises the step of heat-treating the metallic glass alloy for a time and at a temperature sufficient to achieve stress relief without inducing precipitation of discrete particles therein.

Metallic glass alloys treated in accordance with the method of this invention are especially suitable for use in devices requiring high response to weak magnetic fields, such as ground fault interrupters and current/potential transformers.

BRIEF DESCRIPTION OF THE DRAWINGS

The invention will be more fully understood and further advantages will become apparent when reference is made to the following detailed description and the accompanying drawings in which.

DETAILED DESCRIPTION OF THE INVENTION

Figure 1:
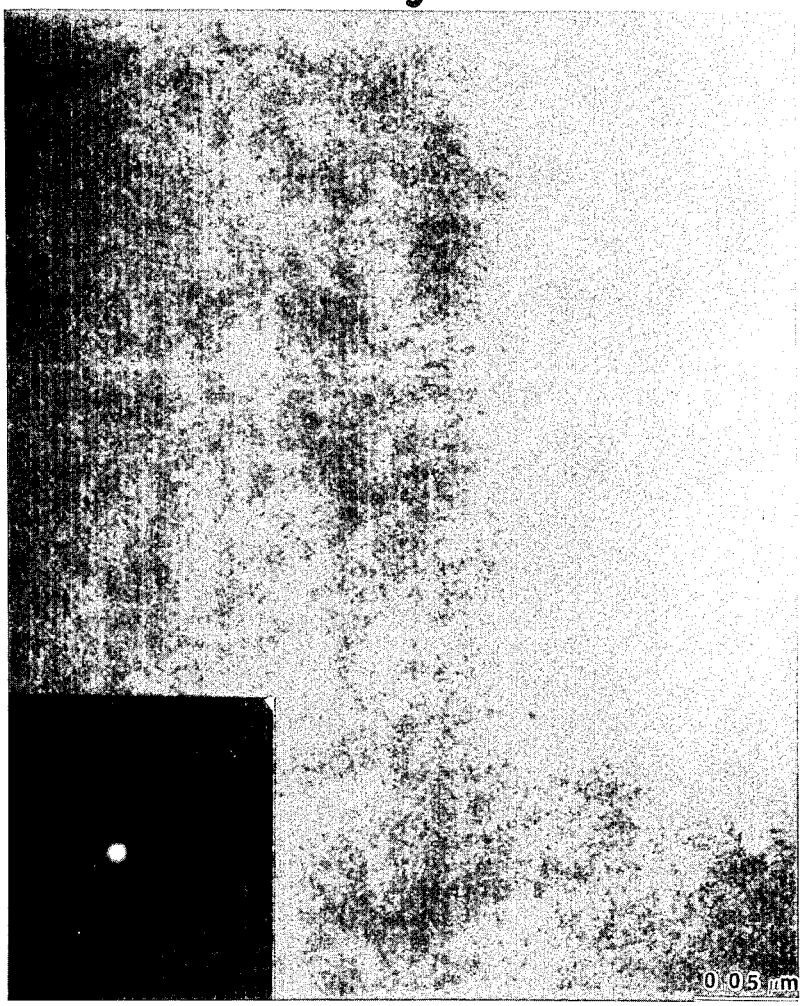
FIG. 1 is a transmission electron micrograph of a metallic glass $Fe_{75}Ni_4Mo_3B_{16}Si_2$ heat-treated by the method of the present invention showing a fully amorphous structure.

Heat treatment of the metallic glass alloys of the invention enhances the magnetic properties thereof. More specifically, upon heat treatment in accordance with the invention, the metallic glass alloys evidence a superior combination of the following thermal and magnetic properties: (i) high maximum permeability (e.g. a maximum of about 250,000–350,000 at 60 Hz), low magnetostriction (about 12–24 ppm), low coercivity (about 0.25–2 A/m), low ac core loss (about 1–3 mW/kg at 60 Hz and 0.1 T), low exciting power (1.5–5 mVA/kg) and high thermal stability (first crystallization temperature of about 475°–600° C.). The alloys consist essentially of about 58 to 81 atom percent iron, about 1 to 10 atom percent of at least one member selected from the group consisting of nickel and cobalt, about 1 to 6 atom percent of at least one member selected from the group consisting of chromium, molybdenum, vanadium, niobium, and zirconium, about 11 to 27.5 atom percent boron, about 0.5 to 8 atom percent silicon, 0 to about 2 atom percent carbon, plus incidental impurities, the total of boron, silicon, and carbon present ranging from about 17 to 28 atom percent. The alloys of the present invention are substantially completely glassy, that is to say, they are at least about 95% amorphous, preferably at least about 97% amorphous, and, most preferably, 100% amorphous as determined by transmission electron microscopy and X-ray diffraction. The best magnetic properties are obtained in alloys having the greatest volume percent of amorphous material. The heat treatment of the alloys is carried out at a temperature and for a time sufficient to achieve stress relief without inducing precipitation of discrete particles therein. The precipitation of discrete particles results in increased coercivity. Preferably, the heat-treating step further comprises the steps of (a) heating the alloy to a temperature at least that sufficient to achieve stress relief; (b) cooling the alloy to a temperature below about 200° C.; and (c) applying a magnetic field to the alloy during at least the cooling step. The cooling step is typically carried out at a cooling rate of about 0.5° C./min. to 100° C./min. However, faster cooling rates, such as are achieved by quenching the alloy in a liquid medium selected from the group consisting of water, brine and oil, can also be used. The highest permeability is obtained in an alloy which is cooled slowly, for example, at a rate of between about −0.5° C./min and −10° C./min.

It is generally found that the process of forming metallic glass alloys results in cast-in stresses. Further stresses may be introduced by the process of fabricating cores from metallic glass alloys. Hence, it is preferred that the metallic glass alloy be heated to a temperature and held for a time sufficient to relieve these stresses. Furthermore, during that heat treatment, the presence of a magnetic field enhances the formation of magnetic anisotropy in the direction along which the field is applied. The field is especially effective when the alloy is at a temperature which is near the Curie temperature or up to 50° C. below and which is high enough to allow atomic diffusion or rearrangement. Thus it is especially preferred that the alloy be annealed at a temperature above the Curie temperature and that it be cooled through the Curie temperature to a temperature at least 50° C. therebelow in the presence of applied field. Below about 200° C., the atomic mobility is too low for the field to be of particular effectiveness.

The resulting material is especially suited for application in magnetic devices operating at line frequencies (50–400 Hz).

The magnetic cores of the invention are preferably fabricated by first forming the metallic glass into the desired final shape (e.g., a core) and then subjecting the core to the appropriate heat treatment described herein. The magnetic fields are, optionally, applied in the longitudinal or transverse directions, defined, respectively, as the direction along which the core is magnetically excited during operation and the direction perpendicular to that of magnetic excitation during operation. Most preferably, the core is a wound toroid in which a continuous ribbon of metallic glass is wound upon itself or upon a supporting bobbin. For such a core, the longitudinal direction is the circumferential direction in which the ribbon is wound and the transverse direction is parallel to the axis of the toroid. A longitudinal magnetic field ($H \parallel$) is conveniently applied to a toroid either by passing a suitable electric current through a set of toroidally wound windings or by passing a suitable current through at least one conductor directed through the center of, and parallel to the axis of, the toroid. A transverse magnetic field ($H\perp$) is conveniently applied by placing the toroid coaxially between the poles either of permanent magnets or of an electromagnet or by placing the toroid coaxially inside a solenoid energized by a suitable electric current.

The temperature ($T_a$) and holding time ($t_a$) of the preferred heat treatment of the metallic glasses of the present invention are dependent on the composition of the alloy. When the total of boron, silicon, and carbon present is about 17–21 atom percent and the total of the elements of groups IVA, VA, and VIA (i.e., Mo, Cr, Zr, Nb, and V) present is about 1–2 atom percent, then $T_a$ is about 340°–400° C. and $t_a$ is 0.25–1 h; when the total of boron, silicon, and carbon present is about 17–21 and the total of the elements of groups IVA, VA, and VIA present is about 3–6 atom percent, then $T_a$ is about 340°–415° C. and $t_a$ is 0.25–2 h; when the total of boron, silicon, and carbon present is about 22–28, then $T_a$ is about 340°–415° C. and $t_a$ is 0.25–2 h.

The preferred method of enhancing the magnetic properties of the alloys of the present invention is further characterized by the choice of two different directions of the magnetic field applied during the heat treatment. The direction is chosen on the basis of the desired final properties.

The first preferred method comprises a heat treatment in a longitudinal field whose preferred strength ranges from about 200 to 400 A/m. The temperature and duration of anneal are chosen to be adequate to achieve stress relief without inducing precipitation of discrete particles in the alloy. The resulting material is characterized by a square hysteresis loop with low coercivity and high permeability, especially for excitation at frequencies of 50–400 Hz. Preferably, the squareness ratio, defined as the ratio of remanent to saturation induction, is at least 0.85, the maximum permeability measured at 60 Hz is at least 250,000, and more preferably, at least 350,000, and the coercivity is less than 1 A/m, preferably less than 0.75 A/m, and most preferably less than 0.5 A/m. Magnetic cores fabricated with such annealed material are especially suited for devices such as ground fault interrupters which detect the presence of low ac magnetic fields. The high magnetic permeability renders such devices more sensitive.

The second preferred method is a heat treatment in the presence of a transverse field, and, optionally, in the presence of a mixed magnetic field having a first component applied in the transverse direction and a second component applied in the longitudinal direction. For heat treatment in the presence of a transverse field, the field strength is typically about 2400 to 16,000 A/m. For heat treatment in the presence of a mixed field, the first component has a strength of about 4,000 to 16,000 A/m and the second component has a strength of about 0 to about 2400 A/m. The duration and temperature of heat treatment are chosen as in the first method. The resulting material is characterized by low dc coercivity, low squareness ratio, and high permeability over a wide range of applied field, Preferably, the coercivity is less than 0.75 A/m and, within a range of magnetic fields applied at 60 Hz whose maximum and minimum peak amplitudes are in a ratio of at least 30:1, the impedance permeability is at least 30,000 and varies by no more than a factor of three. That is, the maximum and minimum values of the impedance permeability have a ratio not exceeding about 3:1. Magnetic cores fabricated with such annealed material are especially suited for applications such as current/potential transformers which measure the intensity of an ac field. The near constant permeability allows a device such as a current/potential transformer to provide a linear output over a wide range of applied fields. The high permeability renders a device more sensitive at lower applied fields.

Alloys heat-treated with applied transverse field in accordance with present invention have a further advantage in their higher permeability under unipolar magnetic excitation than that of heat-treated alloys of the prior art. The magnetic permeability measured under unipolar excitation (e.g., full-wave or half-wave rectified ac current) is generally much lower than that measured under bipolar excitation (e.g., sinusoidal current), since the maximum unipolar flux swing is limited to the difference between saturation and remanent induction measured at the desired frequency, compared to twice the saturation induction for bipolar excitation. Furthermore, the BH loop of prior art materials has higher squareness ratio when measured at line frequencies than at dc, leading to a further reduction in the difference between saturation and remanence and, hence, a lower unipolar permeability. In contrast, the heat-treated alloys of the present invention show acceptably high unipolar flux swing and permeability. For example, Table I compares permeabilities of $Fe_{75.5}Ni_4Mo_3B_{15.5}Si_2$ annealed with the method of present invention and $Fe_{78}B_{13}Si_9$ annealed by the prior art method, demonstrating the superiority of the present invention.

TABLE I

Permeabilities of (A) $Fe_{75.5}Ni_4Mo_3B_{15.5}Si_2$ metallic glass annealed at 400° C. for 1 h with $H_{||}$ = 1600 A/m and $H_{\perp}$ = 8000 A/m and (B) prior art $Fe_{78}B_{13}Si_9$ annealed with $H_{||}$ = 800 A/m at 400° C. for 2 h excited with sinusoidal (bipolar) and full-wave rectified sinusoidal (unipolar) 60 Hz current to the maximum field $H_m$ shown.

| RMS Excitation | Impedance Permeability | |
|---|---|---|
| $H_m$(A/m) | A | B |
| (Unipolar) | | |
| 0.16 | 21,920 | 4,645 |
| 0.40 | 51,560 | 2,312 |
| 0.80 | 84,020 | 2,934 |
| 1.60 | 118,050 | 6,868 |
| 2.40 | 118,680 | 8,282 |
| 2.80 | 115,730 | 7,544 |
| 3.20 | 112,430 | — |
| 3.60 | 109,140 | 7,182 |
| 4.00 | 103,690 | — |
| 4.80 | 90,560 | 6,290 |
| 5.60 | 77,710 | — |
| (Bipolar) | | |
| 0.16 | 68,690 | 1,295 |
| 0.40 | 109,200 | 3,077 |
| 0.80 | 176,630 | 19,045 |
| 1.60 | 152,370 | 66,410 |
| 2.40 | 128,680 | 157,494 |
| 3.2 | — | 167,368 |

Metallic glass alloys consisting essentially of about 68 to 78 percent iron, about 2 to 5 of at least one member selected from the group consisting of nickel and cobalt, about 2 to 5 atom percent of at least one member selected from the group consisting of chromium and molybdenum, about 14 to 19 atom percent boron, about 2 to 5 atom percent silicon, from 0 to 1 atom percent carbon, the total of boron, silicon and carbon present ranging from about 17 to 22, when heat treated at a temperature of 380°–415° C. for a period of 0.25–2 hours in the presence of an applied magnetic field, produce a particularly outstanding combination of high permeability, low coercivity, low ac core loss, low exciting power and high thermal stability. These properties make the alloys especially suited for use in ground fault interrupters and current/potantial transformers. Accordingly such alloy are preferred.

Saturation magnetostriction is the change in the length of a magnetic material under the influence of a saturating magnetic field. A lower saturation magnetostriction renders a material less sensitive to externally applied stresses. Magnetostriction is usually discussed in terms of the ratio of the change in length to the original length, and is given in parts per million (ppm). Prior art iron rich metallic glasses evidence saturation magnetostrictions of about 30 ppm as do metallic glasses without the presence of any of the elements belonging to the IVA, VA, and VIA columns of the periodic table, such as molybdenum. For example, a prior art iron rich metallic glass designated for use in line frequency applications and having the composition $Fe_{78}B_{13}Si_9$ has a saturation magnetostriction of about 30ppm. In contrast, a metallic glass of the invention having the composition $Fe_{75}Ni_4Mo_3B_{16}Si_2$ has a saturation magnetostriction of about 20 ppm.

It is well-known as a guiding principle in the art of magnetic materials that reduction of magnetostriction by appropriate selection of alloy composition yields a product with enhanced magnetic properties, such as higher permeability and reduced core loss. See, e.g., Richard M. Bozorth, *Ferromagnetism* (New York: D. Van Nostrand, 1951), pp. 626–627. The alloys of the present invention have magnetic properties for line frequency (50–400 Hz) applications that are far better than would be expected, given that their saturation magnetostrictions ($\lambda_s$) are in the range of 18–22 ppm. Their line frequency properties are comparable to those of the FeNi-based glasses containing nearly equal amounts of Fe and Ni ($\lambda_s \sim -12$ ppm) and crystalline permalloys containing about 80 percent Ni ($\lambda_s$°0).

The prior art FeNi- and Co-based amorphous alloys and crystalline permalloys require the presence a substantial fraction of either Ni or Co to achieve the desired properties. The relatively higher raw material cost of Ni and Co compared to that of Fe therefore renders these prior art amorphous and crystalline alloys inferior for application to the heat-treated alloys of the present invention.

Ac core loss is that energy loss dissipated as heat. It is the hysteresis in an ac field and is measured by the area of a B-H loop for low frequencies (less than about 1 kHz) and from the complex input power in the exciting coil for high frequencies (about 1 kHz to 1 MHz). The major portion of the ac core loss at high frequencies arises from the eddy current generated during flux change. However, a smaller hysteresis loss and hence a smaller coercivity is desirable especially at line frequency. A lower core loss renders a material more useful in certain applications such as tape recorder heads and transformers. Core loss is discussed in units of watts/kg at a specified maximum induction level and at a specified frequency. For example, a prior art heat-treated metallic glass having the composition $Fe_{40}Ni_{36}Mo_4B_{20}$, has an ac core loss of 0.07 watts/kg at an induction of 0.1 Tesla and a frequency of 1 kHz, while a metallic glass having the composition $Fe_{76}Mo_4B_{20}$ has an ac core loss of 0.08 watts/kg at an induction of 0.1 Tesla and the same frequency. In contrast, a metallic glass alloy of the invention having the composition $Fe_{75}Ni_4Mo_3B_{16}Si_2$ has an ac core loss of 0.05 watts/kg at an induction of 0.1 Telsa and the same frequency.

Exciting power is a measure of power required to maintain a certain flux density in a magnetic material. It is desirable that a magnetic material to be used in magnetic devices have an exicting power as low as possible. Exciting power ($P_e$) is related to the above-mentioned core loss (L) through the relationship $L = P_e \sin \delta$ where $\delta$ is the phase shift between the exciting field and the resultant induction. The phase shift is also related to the magnetostriction in such a way that a lower magnetostriction value leads to a lower phase shift. It is then advantageous to have the magnetostriction value as low as possible. As mentioned earlier, prior art iron-rich metallic glasses such as $Fe_{78}B_{13}Si_9$ have the magnetostriction value near 30 ppm, in contrast to the magnetostriction value of about 20 ppm of the metallic glasses of the present invention.

Magnetic permeability is the ratio of induction to applied magnetic field. A higher permeability renders a material more useful in certain applications such as ground fault interrupters, due to the increased sensitivity. A particular measure of permeability under ac excitation is impedance permeability, defined to be the ratio of the apparent maximum induction to the apparent maximum magnetic field, as determined for a magnetic core from the root mean square (rms) value of the voltage induced in a set of secondary windings and the rms value of exciting current in a set of primary windings, respectively. Especially noted is the fact that a heat-treated $Fe_{75.5}Ni_4Mo_3B_{15.5}Si_2$ metallic glass has an impedance permeability of about 390,000 while the best heat-treated prior art $Fe_{78}B_{13}Si_9$ metallic glass has an impedance permeability of 100,000 at 60 Hz and at the induction level of 0.6 Tesla.

Figure 2:
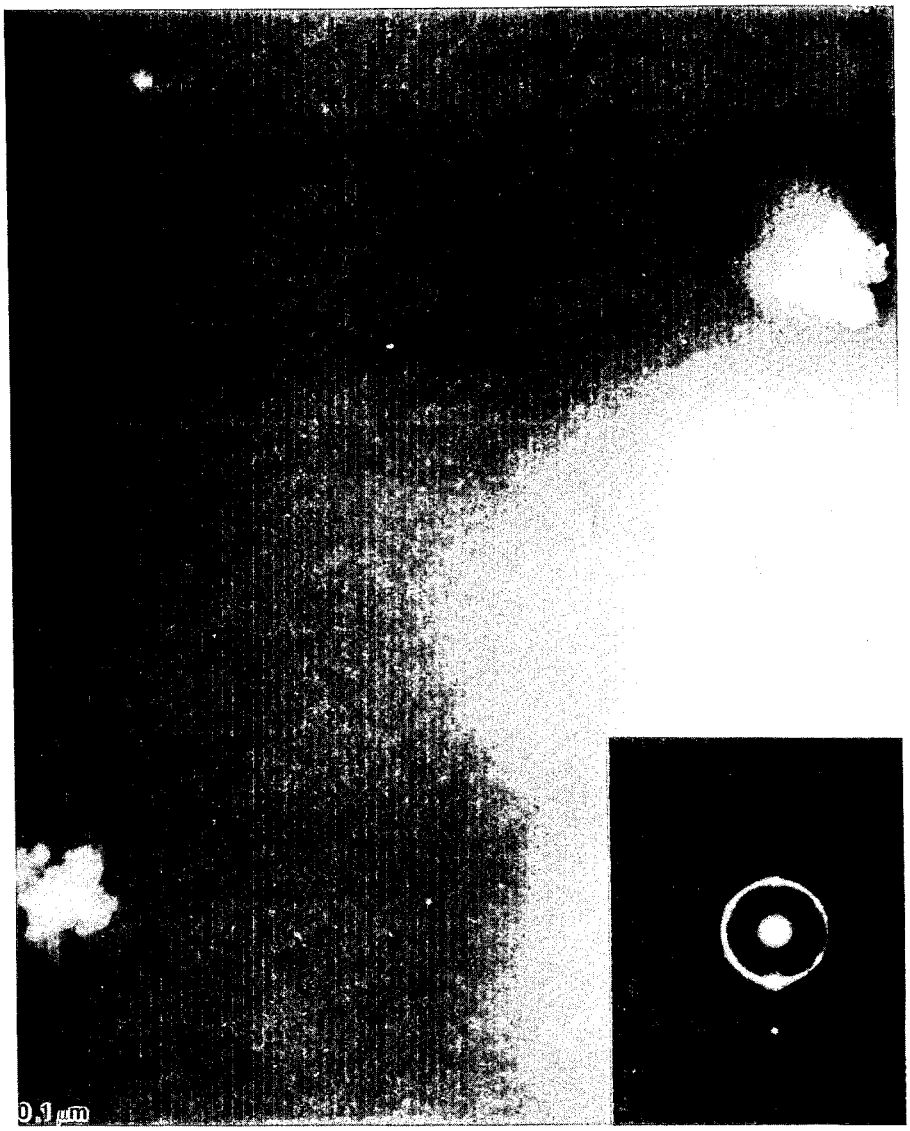
FIG. 2 is a transmission electron micrograph of a metallic glass $Fe_{75}Ni_4Mo_3B_{16}Si_2$, heat-treated by a method that results in precipitation of discrete crystalline particles of the constituents of the alloy within a predominantly amorphous matrix.

In applicant's applications Ser. No. 295,165, filed Aug. 21, 1981, and Ser. No 319,514, filed Nov. 9, 1981, it is disclosed and claimed that the high frequency (f > 1 kHz) magnetic properties of certain iron-based metallic glasses are enhanced by a heat treatment at a temperature and for a time sufficient to induce precipitation of discrete particles into the amorphous matrix. Such a heat treatment is distinguished from the heat treatment of the present invention in that the line frequency properties of metallic glasses heat treated according to the method of the present invention are superior to those of glasses heat treated according to the method of the prior inventions. Conversely, the high frequency properties of metallic glasses heat-treated according to the method of the prior invention are superior. Table II shows representative properties of a metallic glass having the composition $Fe_{75}Ni_4Mo_3B_{16}Si_2$ heat-treated according to the methods of the present and the prior inventions. The distinction is made clear by reference to FIGS. 1 and 2 showing, respectively, transmission electron micrographs of samples taken from the heat-treated toroids A and B of Table II. FIG. 1 shows sample A, heat treated according to the method of the present invention, which is a substantially completely glassy material; FIG. 2, shows sample B heat-treated according to the method of the prior art invention to produce the discrete crystalline particles of the constituents of the amorphous matrix seen in the micrograph.

TABLE II

Magnetic properties of toroids fabricated from the same cast of $Fe_{75}Ni_4Mo_3B_{16}Si_2$ metallic glass and heat treated by the method of the present invention (A) and by the method of Application Ser. No. 319,514 (B). Sample A was treated at 400° C. for 1 h in the presence of an 800 A/m longitudinal field. Sample B was treated at 420° C. for 2.5 h in zero applied field. Core loss (L), exciting power ($P_e$) and impedance permeability $\mu_z$ were measured at f = 60 Hz/$B_m$ = 0.2 Tesla and at f = 50 kHz/$B_m$ = 0.1 Tesla.

| | $H_c$ | 60 Hz properties | | | 50 kHz properties | | |
|---|---|---|---|---|---|---|---|
| | (A/m) | L(mW/kg) | $P_e$(mVA/kg) | $\mu_z$ | L(W/kg) | $P_e$(VA/kg) | $\mu_z$ |
| A. | 1.16 | 7.35 | 7.70 | 108,600 | 28.6 | 41.4 | 4040 |
| B. | 9.28 | 29.3 | 42.7 | 28,200 | 13.2 | 30.3 | 5505 |

As is well known in the art (see, e.g., Donald G. Fink and H. Wayne Beaty, *Standard Handbook for Electrical Engineers* (New York: McGraw Hill, 1978) pp. 3-23–3-24), current/potential transformers are devices used to monitor currents or voltages either where the currents or voltages are too large for conventional meters or where it is desired to have the measuring instrument electrically isolated from the circuit being tested. The transformer typically comprises a toroidal core with primary and secondary windings. For monitoring current, the primary consists of at most a few turns connected in series with the load and the secondary has many turns, frequently more than 200. For monitoring potential, the primary has many turns and is connected in parallel with the load and the secondary has few turns. The voltage induced in the secondary is proportional to the primary current or voltage, as appropriate.

It has long been recognized in the art (see, e.g., H. Pender, W. A. Del Mar, and K. McIlwain, Electrical Engineers' Handbook: Electrical Power (New York: John Wiley, 1941), pp. 5-55–5-60) that smaller, more efficient, and more accurate current/potential transformers could be built by employing magnetic cores having higher permeability, lower losses, lower phase shift and lower exciting power. Yet up to the time of the present invention, metallic glass cores having the requisite combination of properties, e.g., high maximum permeability, low magnetostriction, low ac core loss, low exciting power and high thermal stability, have not been available. It has been discovered that cores comprised of metallic glass allloys annealed in accordance with the present invention have this requisite combination of properties. Hence current/potential transformers employing the magnetic cores of the present invention are superior to transformers employing prior-art cores.

As is well known in the art, e.g., U.S. Pat. No. 4,353,103 issued Oct. 5, 1982 to G. A. Whitlow, a ground fault interrupter is an electrical protective device which interrupts the flow of electrical supply current to a circuit upon occurence of a ground fault, i.e., an imbalance between the current flowing from the electrical power distribution system into a load and the current returning to the distribution system from the other side of the load. Such an imbalance is indicative of a ground fault current flowing from some point in the load to ground by an alternate path. Such a leakage current is potentially hazardous, as in the case of a leakage current flowing through the body of the user of a defective appliance. Ground fault interruption means are now required by electrical codes for electrical service in certain hazardous locations, e.g., outlets in garages, bathrooms, and outdoors.

A ground fault interrupter frequently comprises a differential current transformer with a toroidal magnetic core. The primary of the transformer has separate windings through which the supply current and the return current, respectively, pass. The windings are disposed in such a manner that when the supply and return currents are equal, i.e., no ground fault exists, the magnetic fields produced by the separate windings cancel. When a ground fault occurs the cancellation is no longer exact. The resulting ac magnetic field induces a voltage in a multiturn secondary winding which is used to activate means for interrupting the flow of suppy current.

The sensitivity of a ground fault interrupter is determined by the permeability of the magnetic core. That is, for a given size of core, the ground fault current trip level decreases as permeability increases. Alternatively, the core size needed for a ground fault interrupter designed to trip at a given ground fault current decreases as the permability of the core increases. Hence, the high permeability alloys of the present invention are highly preferred for application in ground fault interrupters. Devices comprising differential current transformers with the toroid magnetic cores of the invention have lower ground fault current trip levels and/or smaller size than devices employing prior art codes.

EXAMPLES

Example 1

Fe-Ni-Mo-B-Si

Ribbons having compositions given by $Fe_{100-a-b-c-d}Ni_aMo_bB_cSi_d$ and having dimensions about 0.5 to 2.5 cm wide and about 25 to 50 μm thick were formed by squirting a melt of the particular composition through an orifice by an overpressure of argon onto a rapidly rotating copper chill wheel (surface speed about 3000 to 6000 ft/min.). Magnetic cores were formed by winding the ribbon thrus produced onto toroidal ceramic bobbins and were heat-treated in a tube furnace. Longitudinal magnetic fields were produced by passing the requisite electric current through a set of copper windings applied to the toroid. Transverse magnetic fields were produced either by placing the toroids axially between the poles of two permanent magnets or by placing the toroid coaxially within a solenoid carrying the requisite electric current.

Impedance permeability, magnetostriction, core loss, magnetization and coercive field were measured by conventional techniques employing B-H loops, metallic strain gauges and vibrating sample magnetometer. Curie temperature and crystallization temperature were measured, respectively, by an induction method and by differential scanning calorimetry. The measured values of room temperature saturation magnetization, Curie temperature, room temperature saturation magnetostriction and the first crystallization temperature are summarized in Table III below.

TABLE III

| Ex. No | Composition (at. %) Fe | Ni | Mo | B | Si | $\sigma_s$ (emu/g) | $\theta_f$ (°C.) | $T_{x1}$ (°C.) | $\lambda_s$ (ppm) |
|---|---|---|---|---|---|---|---|---|---|
| 1 | 73 | 4 | 2 | 16 | 5 | 147.7 | 338 | 542 | 21.5 |
| 2 | 71 | 4 | 4 | 16 | 5 | 125.8 | 281 | 548 | — |
| 3 | 69 | 4 | 6 | 16 | 5 | 103.2 | 197 | 559 | 8.6 |
| 4 | 73 | 2 | 4 | 16 | 5 | 129.0 | 249 | 579 | 13.5 |
| 5 | 69 | 6 | 4 | 16 | 5 | 123.5 | 284 | 545 | 12.6 |
| 6 | 67 | 8 | 4 | 16 | 5 | 122.7 | 277 | 571 | 13.3 |
| 7 | 65 | 10 | 4 | 16 | 5 | 120.5 | 299 | 536 | 12.2 |
| 8 | 71 | 4 | 4 | 20 | 1 | 122.8 | 274 | 539 | 15.2 |
| 9 | 71 | 4 | 4 | 18 | 3 | 127.1 | 283 | 548 | 14.4 |
| 10 | 71 | 4 | 4 | 14 | 7 | 128.0 | 285 | 562 | 16.0 |
| 11 | 58 | 8 | 6 | 22 | 6 | 110.0 | 323 | 582 | 11.2 |
| 12 | 69 | 2 | 1 | 27.5 | 0.5 | 145.2 | — | 487 | 21.8 |
| 13 | 75 | 4 | 4 | 11 | 6 | 123.0 | 230 | 493 | 17.4 |
| 14 | 81 | 1 | 1 | 13 | 4 | 160.7 | 306 | 459 | 30.1 |
| 15 | 77 | 2 | 3 | 17.5 | 0.5 | 134.8 | 262 | 500 | 19.0 |
| 16 | 75 | 4 | 3 | 17.5 | 0.5 | 135.6 | 277 | 496 | 20.0 |

TABLE IV

| Example Number | $T_a$ (°C.) | $t_a$ (h) | $B_r$ (T) | $H_c$ (A/m) | L (mW/kg, $B_m$ = 0.1 T) | μ 0.1 T | μ 0.5 T |
|---|---|---|---|---|---|---|---|
| 1 | 400 | 1 | 2.94 | 1.5 | 2.0 | 82,000 | 219,090 |
| 2 | 400 | 1 | 0.67 | 1.7 | 2.3 | 67,232 | 129,550 |
| 3 | 400 | 1 | 0.35 | 2.0 | 2.6 | 54,680 | 25,970 |
| 4 | 400 | 1 | 0.45 | 2.2 | 2.9 | 47,320 | 46,020 |
| 5 | 400 | 1 | 0.60 | 2.0 | 2.5 | 60,690 | 103,840 |
| 6 | 400 | 1 | 0.60 | 1.8 | 2.3 | 67,950 | 118,680 |
| 7 | 400 | 1 | 0.65 | 1.5 | 2.1 | 72,540 | 143,100 |
| 8 | 400 | 1 | 0.51 | 2.1 | 2.3 | 56,650 | 68,160 |
| 9 | 400 | 1 | 0.51 | 3.8 | 3.1 | 33,970 | 44,109 |
| 10 | 400 | 1 | 0.55 | 3.6 | 3.8 | 40,890 | 56,150 |
| 11 | 370 | 1 | 0.89 | 4.1 | 5.9 | 29,990 | 93,440 |
| 12 | 370 | 1 | 0.78 | 2.3 | 2.5 | 54,380 | 141,720 |
| 13 | 370 | 1 | 0.62 | 1.4 | — | 74,340 | 138,640 |

The magnetic properties of these glassy alloys after annealing in a longitudinal applied field are presented in Table IV. Optimum annealing conditions for the metallic glass $Fe_{75.5}Ni_4Mo_3B_{15.5}Si_2$ and the obtained results are summarized in Table V. Frequency dependence of permeability of this optimally annealed alloy is listed in Table VI.

Table VII lists magnetic properties of the metallic glass alloy $Fe_{75.5}Ni_4Mo_3B_{15.5}Si_2$ heated to 400° C., held for 1 h, and cooled below 200° C. at various rates, all in the presence of a 1600 A/m longitudinal field. Values of dc remanent induction ($B_r$), dc coercive field ($H_c$) and 60 Hz core loss (L) and impedance permeability ($\mu_z$) are shown for a maximum induction ($B_m$). The best properties are seen to have resulted from cooling rates of −0.5° C./min to −10° C./min.

TABLE VII

| Average Cooling Rate (°C./min) | $B_r$ (T) | $H_c$ (A/m) | L (mW/kg) ($B_m$ =0.1 T) | $\mu_z$ 0.1 T | $\mu_z$ 0.5 T |
|---|---|---|---|---|---|
| −1 | 1.00 | 0.5 | 1.0 | 173,380 | 389,440 |
| −3 | 0.93 | 0.6 | 1.2 | 144,500 | 321,050 |
| −10 | 0.98 | 0.7 | 1.2 | 138,542 | 306,450 |
| −1000* | 0.47 | 3.5 | 1.8 | 88,980 | 155,700 |

*Quenched in water

The presence of molybdenum is seen to increase the permeability and the crystallization temperature and to lower the ac core loss, exciting power and magnetostriction. Especially noted is the fact that the optimally heat-treated metallic glass $Fe_{75.5}Ni_4Mo_3B_{15.5}Si_2$ of the present invention has a coercivity of 0.5 A/m and has a low core loss of 1.2 mW/kg and impedance permeability of 390,000 at 60 Hz and at the induction level of 0.6 Tesla. The combination of these properties make these compositions suitable for line frequency devices such as ground fault interrupters and current transformers.

TABLE V

Magnetic properties of the metallic glass $Fe_{75.5}Ni_4Mo_3B_{15.5}Si_2$ heat-treated at temperature $T_a$ for a holding time $t_a$ in the presence of various longitudinal magnetic fields. Toroids were cooled to room temperature at a rate −3° C./min. following the heat-treatment. Core loss (L) and impedance permeability ($\mu_z$) were measured using sinusoidal field excitation at 60 Hz to a maximum induction $B_m$ as indicated.

TABLE V

| Example Number | $T_a$(°C.) | $t_a$(h) | Annealing Field (A/m) | $H_c$ (A/m) | $B_r$ (T) | L(mW/kg) ($B_m$ = 0.1 T) | $\mu_z$ $B_m$ (T)0.05 | 0.1 T | 0.4 T | 0.6 T |
|---|---|---|---|---|---|---|---|---|---|---|
| 17 | 400 | 1 | 1600 | 0.58 | 0.89 | 1.2 | 93,250 | 144,500 | 296,700 | 345,400 |
| 18 | 400 | 1 | 3200 | 0.58 | 0.95 | 1.1 | 102,512 | 155,140 | 306,760 | 357,070 |
| 19 | 390 | 2 | 800 | 0.58 | 0.95 | 1.7 | 83,080 | 128,060 | 272,560 | 313,980 |
| 20 | 390 | 3 | 800 | 0.86 | 0.93 | 1.6 | 85,350 | 130,730 | 272,950 | 316,060 |
| 21 | 390 | 4 | 800 | 0.58 | 0.95 | 1.4 | 96,470 | 144,842 | 289,840 | 334,120 |
| 22 | 410 | 2 | 800 | 0.29 | 0.99 | 1.4 | 102,190 | 154,230 | 306,530 | 369,725 |
| 23 | 410 | 1.5 | 800 | 0.58 | 0.96 | 1.4 | 105,830 | 159,170 | 317,190 | 362,010 |
| 24 | 400 | 1 | 0 | 1.2 | 0.85 | 2.0 | 67,280 | 102,620 | 211,950 | — |
| 25 | 380 | 1 | 0 | 1.6 | 0.84 | 2.3 | 49,147 | 75,300 | 174,250 | — |
| 26 | 340 | 1 | 0 | 2.3 | 0.50 | 4.4 | 31,170 | 49,570 | 110,300 | — |
| 27 | 400 | 1 | 800 | 0.58 | 0.93 | 1.1 | 106,720 | 160,840 | 317,070 | — |
| 28 | 380 | 1 | 800 | 0.58 | 1.02 | 1.8 | 64,370 | 99,590 | 216,310 | — |
| 29 | 340 | 1 | 800 | 1.9 | 0.54 | 2.9 | 35,510 | 57,100 | 131,050 | — |
| 30 | 380 | 1 | 0 | 1.7 | 0.71 | 3.1 | — | 52,930 | — | — |
| 31 | 420 | 1 | 0 | 1.2 | 0.75 | 2.7 | 51,420 | 75,670 | — | — |
| 32 | 360 | 1 | 800 | 1.7 | 0.69 | 2.6 | 39,190 | 64,430 | — | — |
| 33 | 380 | 1 | 800 | 1.2 | 0.82 | 2.4 | 45,310 | 71,030 | — | — |
| 34 | 420 | 1 | 800 | 0.58 | 0.98 | 1.3 | 96,370 | 140,720 | — | — |
| 35 | 400 | 0.5 | 800 | 0.58 | 0.95 | 1.2 | 100,290 | 153,090 | 311,460 | 358,960 |
| 36 | 400 | 2 | 800 | 0.58 | 0.93 | 1.2 | 104,470 | 157,730 | 332,260 | 391,910 |
| 37 | 400 | 3 | 800 | 0.58 | 0.95 | 1.2 | 102,910 | 158,490 | 324,230 | 384,030 |
| 38 | 400 | 1 | 200 | 0.73 | 0.93 | 1.2 | 95,210 | 140,980 | — | — |

TABLE VI

Frequency dependence of impedance permeability $\mu_z$ of metallic glass $Fe_{75.5}Ni_4Mo_3B_{15.5}Si_2$ annealed for 2 h at 410° C., with an 800 A/m longitudinal field.

| f(Hz) | $\mu_z$ $B_m$(T)0.01 | 0.1 | 0.6 |
|---|---|---|---|
| 50 | 31,620 | 143,070 | 353,690 |
| 60 | 31,940 | 137,220 | 330,760 |
| 100 | 31,080 | 122,150 | 266,660 |
| 200 | 28,680 | 99,560 | 187,620 |
| 400 | 26,090 | 76,670 | 126,870 |
| 1000 | 22,123 | 50,500 | 70,290 |
| 2000 | 18,190 | 34,420 | 44,830 |

TABLE IX

Field dependence of the 60 Hz impedance permeability of metallic glass $Fe_{75.5}Ni_4Mo_3B_{15.5}Si_2$ annealed for 1 h at 400° C. with transverse and longitudinal fields of 8000 and 1600 A/m, respectively, showing peak applied 60 Hz magnetic field $H_m$, impedance permeability $\mu_z$, and maximum induction $B_m$.

| $H_m$(A/m) | $\mu_z$ | $B_m$(Tesla) |
|---|---|---|
| 8.3 | 95,910 | 1.0 |
| 6.0 | 105,710 | 0.8 |

TABLE IX-continued

Field dependence of the 60 Hz impedance permeability of metallic glass $Fe_{75.5}Ni_4Mo_3B_{15.5}Si_2$ annealed for 1 h at 400° C. with transverse and longitudinal fields of 8000 and 1600 A/m, respectively, showing peak applied 60 Hz magnetic field $H_m$, impedance permeability $\mu_z$, and maximum induction $B_m$.

| $H_m$(A/m) | $\mu_z$ | $B_m$(Tesla) |
|---|---|---|
| 4.2 | 113,190 | 0.6 |
| 3.4 | 116,780 | 0.5 |
| 2.1 | 115,420 | 0.3 |
| 0.92 | 86,330 | 0.1 |
| 0.45 | 52,830 | 0.03 |
| 0.26 | 31,130 | 0.01 |
| 0.19 | 20,610 | 0.005 |

Table VIII shows magnetic properties of the metallic glass $Fe_{75.5}Ni_4Mo_3B_{15.5}Si_2$ annealed in the presence of various transverse magnetic fields. Table IX shows the detailed field dependence of impedence permeability of optimally transversely annealed $Fe_{75.5}Ni_4Mo_3B_{15.5}Si_2$. That permeability is at least 30,000, and varies by no more than a factor of three for applied fields ranging from 0.3 to 10.0 A/m. The resulting material is especially suited for line frequency current/potential transformers in which the near-constant permeability renders the output nearly linear over a wide range of applied fields.

TABLE VIII

Magnetic properties of the metallic glass $Fe_{75.5}Ni_4Mo_3B_{15.5}Si_2$ heat-treated at temperature $T_a$ for a holding time $t_a$ in the presence of various transverse (H⊥) and, optionally, longitudinal (H||) magnetic fields. Toroids were cooled to room temperature at about −3° C./min. following the heat treatment. Coercivity ($H_c$) and remanent induction ($B_r$) were measured from dc BH loops. Core loss (L) and impedance permeability ($\mu_z$) were measured using sinusoidal field excitation at 60 Hz to a maximum induction $B_m$ as indicated.

TABLE VIII

| Example Number | $T_a$(°C.) | $t_a$(h) | Annealing Field H\|\|(A/m) | H⊥(A/m) | $H_c$(A/m) | $B_r$(T) | L(mW/kg) ($B_m$ = 0.1 T) | $\mu_z$ $B_m$ = 0.05 T | 0.1 T | 0.4 T | 0.6 T |
|---|---|---|---|---|---|---|---|---|---|---|---|
| 39 | 385 | 2 | 1600 | 800 | 1.1 | — | 1.7 | 40,000 | 86,030 | 140,120 | 128,810 |

TABLE VIII-continued

| Example Number | $T_a$(°C.) | $t_a$(h) | Annealing Field H ‖ (A/m) | Annealing Field H⊥(A/m) | $H_c$(A/m) | $B_r$(T) | L(mW/kg) ($B_m$ = 0.1 T) | $\mu_z$ $B_m$ = 0.05 T | $\mu_z$ 0.1 T | $\mu_z$ 0.4 T | $\mu_z$ 0.6 T |
|---|---|---|---|---|---|---|---|---|---|---|---|
| 40 | 400 | 1 | 1600 | 800 | 0.73 | 0.30 | 1.1 | — | 85,330 | 116,100 | 113,190 |
| 41 | 415 | 2 | 1600 | 800 | 1.0 | 0.32 | 1.2 | — | 84,700 | 127,930 | 117,390 |
| 42 | 400 | 1 | 800 | 800 | 0.80 | — | 1.2 | 79,000 | 106,198 | 165,020 | 153,920 |
| 43 | 400 | 1 | 800 | 800 | 0.58 | 0.72 | 1.1 | 105,530 | 155,220 | 301,270 | 343,990 |
| 44 | 400 | 1 | 800 | 2400 | 0.58 | 0.92 | 1.2 | 101,990 | 152,860 | 311,600 | 360,390 |
| 45 | 400 | 1 | 0 | 800 | 0.94 | 0.60 | 1.6 | 67,920 | 98,280 | 159,110 | 133,711 |
| 46 | 400 | 1 | 0 | 800 | 1.0 | 0.85 | 1.8 | 63,700 | 96,820 | 205,210 | 222,790 |
| 47 | 400 | 1 | 0 | 2400 | 1.0 | 0.79 | 1.7 | 66,601 | 100,230 | 205,330 | 215,340 |
| 48 | 400 | 1 | 0 | 4000 | 0.80 | 0.82 | 1.3 | 86,180 | 123,930 | 230,700 | 217,400 |
| 49 | 400 | 1 | 800 | 4000 | 0.72 | 0.57 | 1.2 | 88,660 | 125,350 | 224,740 | 244,720 |
| 50 | 400 | 1 | 240 | 8000 | 1.4 | 0.50 | 1.7 | — | 77,840 | 112,500 | 110,350 |
| 51 | 380 | 1 | 0 | 2400 | 1.7 | — | 2.2 | 47,220 | 71,000 | 165,021 | 172,040 |
| 52 | 400 | 1 | 800 | 16000 | 1.0 | 0.30 | — | — | 87,360 | 133,320 | 102,163 |
| 53 | 400 | 1 | 2400 | 16000 | 1.1 | 0.20 | 1.4 | 49,930 | 63,012 | — | — |

EXAMPLE 2

Fe-Ni-Cr-B-Si System

Ribbons having compositions given by $Fe_{100-a-b-c-d}Ni_aCr_b$-$B_c$-$Si_d$ and having dimensions about 1 cm wide and about 25 to 50 μm thick were formed as in Example 1.

The magnetic and thermal data are summarized in Table X below. The magnetic properties of these glassy alloys after annealing are presented in Table XI.

The line frequency magnetic properties of these metallic glasses are comparable to those containing molybdenum (Example 1).

A combination of low ac core loss and high impedance permeability at line frequency is achieved in the metallic glasses of the present invention. The thermal stability is also shown to be excellent as evidenced by high crystallization temperature. These improved combination of properties of the metallic glasses of the present invention renders these compositions suitable for line frequency magnetic devices such as ground fault interrupters, current/potential transformers and the like.

Table X. Examples of the room temperature saturation magnetization, $\sigma_s$, Curie temperature, $\theta_f$, saturation magnetostriction, $\lambda_s$, and the first crystallization temperature $T_{x1}$, for the metallic glasses having the composition $Fe_{100-a-b-c-d}Ni_aCr_bB_cSi_d$.

TABLE X

| Composition (at. %) Fe | Ni | Cr | B | Si | $\sigma_s$ (emu/g) | $\theta_f$ (°C.) | $T_{x1}$ (°C.) | $\lambda_s$ (ppm) |
|---|---|---|---|---|---|---|---|---|
| 75 | 2 | 4 | 14 | 5 | 129.4 | 278 | 513 | 17.6 |
| 77 | 2 | 2 | 17 | 2 | 152.8 | 331 | 497 | 17.3 |
| 75 | 2 | 4 | 17 | 2 | 133.8 | 266 | 504 | 16.5 |
| 73 | 2 | 6 | 17 | 2 | 114.2 | 218 | 505 | 13.5 |
| 75 | 2 | 4 | 15 | 4 | 127.9 | 278 | 510 | 14.5 |
| 75 | 2 | 4 | 13 | 6 | 130.8 | 271 | 504 | 17.6 |
| 75 | 2 | 4 | 11 | 8 | 132.0 | 283 | 494 | 14.1 |
| 73 | 4 | 4 | 15 | 4 | 131.1 | 281 | 507 | 16.8 |
| 71 | 6 | 4 | 15 | 4 | 131.9 | 305 | 504 | 17.3 |
| 69 | 8 | 4 | 15 | 4 | 128.3 | 313 | 502 | 16.5 |
| 77 | 2 | 2 | 15 | 4 | 149.2 | 330 | 504 | 20.8 |
| 73 | 2 | 6 | 15 | 4 | 115.0 | 217 | 514 | 11.5 |
| 76 | 6 | 4 | 14 | 4 | 129.7 | 308 | 484 | 15.0 |
| 70 | 6 | 4 | 16 | 4 | 128.1 | 310 | 511 | 16.6 |
| 69 | 6 | 4 | 17 | 4 | 129.4 | 319 | 517 | 17.4 |
| 68 | 6 | 4 | 18 | 4 | 124.7 | 310 | 525 | 13.1 |
| 73 | 6 | 4 | 12 | 5 | 131.5 | 293 | 465 | 15.8 |
| 72 | 6 | 4 | 13 | 5 | 126.0 | 288 | 483 | 15.8 |
| 71 | 6 | 4 | 14 | 5 | 128.8 | 312 | 508 | 13.0 |
| 70 | 6 | 4 | 15 | 5 | 129.9 | 295 | 514 | 14.4 |
| 69 | 6 | 4 | 16 | 5 | 125.0 | 305 | 521 | 16.0 |
| 68 | 6 | 4 | 17 | 5 | 122.0 | 319 | 529 | 15.1 |

TABLE XI

Examples of 60 Hz magnetic properties of $Fe_{100-a-b-c-d}Ni_aCr_bB_cSi_d$ metallic glasses. Samples were heat-treated at temperature $T_a$ for a holding time $t_a$ in the presence of an 800 A/m longitudinal field. Values of the dc remanent induction $B_r$, dc coercivity Hc, and 60 Hz impedance permeability $\mu_z$ at maximum inductions of 0.1 and 0.5 Tesla are shown.

TABLE XI

| Composition (at. %) Fe | Ni | Cr | B | Si | $T_a$ (°C.) | $t_a$ (h) | $B_r$ (T) | $H_c$ (A/m) | $\mu_z$ $B_m$(T) 0.1 | $\mu_z$ $B_m$(T) 0.5 |
|---|---|---|---|---|---|---|---|---|---|---|
| 75 | 2 | 4 | 14 | 5 | 385 | 1 | 0.92 | 1.8 | 53,410 | 186,820 |
| 77 | 2 | 2 | 17 | 2 | 370 | 1 | 1.13 | 2.1 | 49,340 | 157,940 |
| 75 | 2 | 4 | 17 | 2 | 370 | 1 | 0.86 | 1.8 | 60,730 | 169,940 |
| 73 | 2 | 6 | 17 | 2 | 350 | 1 | 2.47 | 1.7 | 60,630 | 68,140 |
| 75 | 2 | 4 | 15 | 4 | 370 | 1 | 0.68 | 4.2 | 33,570 | 63,420 |
| 75 | 2 | 4 | 13 | 6 | 370 | 1 | 0.77 | 2.1 | 47,210 | 129,470 |
| 75 | 2 | 4 | 11 | 8 | 350 | 1 | 0.71 | 2.0 | 63,490 | 145,040 |
| 73 | 4 | 4 | 15 | 4 | 370 | 1 | 0.94 | 1.8 | 59,380 | 180,110 |
| 71 | 6 | 4 | 15 | 4 | 370 | 1 | 1.03 | 1.5 | 65,940 | 188,070 |
| 69 | 8 | 4 | 15 | 4 | 370 | 1 | 2.91 | 1.4 | 67,900 | 184,907 |
| 77 | 2 | 2 | 15 | 4 | 350 | 1 | 0.89 | 1.8 | 66,560 | 156,600 |
| 73 | 2 | 6 | 15 | 4 | 370 | 1 | 0.55 | 1.5 | 61,380 | 110,610 |
| 72 | 6 | 4 | 14 | 4 | 380 | 1 | 0.99 | 2.5 | 40,510 | 143,440 |
| 70 | 6 | 4 | 16 | 4 | 380 | 1 | 0.89 | 1.1 | 96,500 | 231,470 |
| 69 | 6 | 4 | 17 | 4 | 400 | 1 | 0.85 | 1.1 | 91,109 | 214,790 |
| 68 | 6 | 4 | 18 | 4 | 380 | 1 | 2.65 | 1.4 | 77,170 | 163,950 |
| 73 | 6 | 4 | 12 | 5 | 380 | 1 | 1.07 | 4.9 | 22,570 | 88,050 |
| 72 | 6 | 4 | 13 | 5 | 380 | 1 | 0.98 | 3.6 | 30,690 | 105,070 |
| 71 | 6 | 4 | 14 | 5 | 380 | 1 | 0.87 | 1.3 | 79,880 | 218,600 |
| 70 | 6 | 4 | 15 | 5 | 380 | 1 | 0.80 | 0.98 | 96,960 | 241,050 |
| 69 | 6 | 4 | 16 | 5 | 400 | 1 | 0.73 | 1.1 | 89,780 | 199,330 |
| 68 | 6 | 4 | 17 | 5 | 400 | 1 | 0.98 | 1.1 | 122,684 | 250,208 |
| 73 | 4 | 2 | 16 | 5 | 400 | 1 | 1.02 | 1.4 | 66,530 | 172,890 |
| 71 | 4 | 4 | 16 | 5 | 420 | 1 | 0.85 | 0.84 | 99,030 | 227,410 |
| 69 | 4 | 6 | 16 | 5 | 400 | 1 | 0.51 | 1.4 | 71,160 | 121,740 |
| 73 | 2 | 4 | 16 | 5 | 400 | 1 | 0.74 | 1.1 | 74,740 | 169,350 |
| 69 | 6 | 4 | 16 | 5 | 400 | 1 | 0.91 | 0.84 | 109,820 | 249,790 |
| 67 | 8 | 4 | 16 | 5 | 400 | 1 | 0.71 | 0.98 | 85,580 | 192,270 |
| 65 | 10 | 4 | 16 | 5 | 400 | 1 | 0.90 | 1.12 | 91,150 | 219,310 |

EXAMPLE 3

Fe-M-M'-S-Bi-C System

Ribbons having composition given by $Fe_{100-a-b-c-d-e}M_aM'_b$-$B_c$-$Si_d$-$C_e$, where M is at least one of nickel and cobalt and M' is at least one of molybdenum, chromium, vanadium, niobium, and zirconium, and having dimensions about 0.5–1 cm wide and about 25 to 50 μm thick were formed as in Example 1.

The magnetic and thermal data are summarized in Table XII below. The magnetic properties of these glassy alloys after annealing are presented in Table XIII.

The line frequency magnetic properties of these metallic glasses are comparable to those containing molybdenum and nickel (Example 1).

A combination of low ac core loss and high impedance permeability at line frequency is achieved in the metallic glasses of the present invention. The thermal stability is also shown to be excellent as evidenced by high crystallization temperature. The improved combination of properties of the metallic glasses of the present invention renders these compositions suitable for line frequency magnetic devices such as ground fault interrupters, current/potential transformers and the like.

TABLE XII

Examples of the room temperature saturation magnetization, $\sigma_s$, Curie temperature, $\theta_f$, saturation magnetostriction, $\lambda_s$, and the first crystallization temperature, $T_{x1}$, for the metallic glasses having the composition $Fe_{100-a-b-c-d-e}M_aM'_bB_cSi_dC_e$.

TABLE XII

| Composition | $\sigma_s$ (emu(g) | $\theta_f$ (K) | $\lambda_s$ (ppm) | $T_{x1}$ (K) |
|---|---|---|---|---|
| $Fe_{75}Ni_4V_3B_{16}Si_2$ | 145.0 | 597 | 24 | 762 |
| $Fe_{75}Ni_4Nb_3B_{16}Si_2$ | 108.6 | 534 | 18 | 785 |
| $Fe_{75}Ni_4Zr_3B_{16}Si_6$ | 146.6 | 597 | 27 | 808 |

TABLE XIII

Examples of the 60 Hz magnetic properties of $Fe_{100-a-b-c-d-e}M_aM'_bB_cSi_dC_e$ metallic glasses listed in Table XII. Samples were heat-treated at temperature $T_a$ for a holding time $t_a$ in the presence of a longitudinal annealing field H || =800 A/m. Values of the dc coercive field $H_c$ and remanent inductors $B_r$ and 60 Hz properties of impedance permeability $\mu_z$ and core loss L at specified maximum induction level $B_m$ are given.

TABLE XIII

| Composition | $T_a$ (°C.) | $t_a$ (h) | $B_r$ (T) | $H_c$ (A/m) | L(mW/kg, $B_m$ = 0.1 T) | $\mu_z$ 0.1 T | $\mu_z$ 0.5 T |
|---|---|---|---|---|---|---|---|
| $Fe_{78}Ni_2Cr_2B_{14}Si_2C_2$ | 370 | 1 | 1.21 | 2.6 | 5.1 | 37,260 | 118,200 |
| $Fe_{18}Ni_2Mo_2B_{12}Si_4C_2$ | 370 | 1 | 0.99 | 1.6 | 3.0 | 61,080 | 170,020 |
| $Fe_{75}Ni_4Nb_3B_{16}Si_2$ | 385 | 1 | — | — | 3.2 | 58,420 | 170,200 |
| $Fe_{75}Ni_4V_3B_{16}Si_2$ | 385 | 1 | — | — | 1.7 | 43,140 | 55,060 |
| $Fe_{75}Ni_4Zr_3B_{16}Si_2$ | 385 | 1 | — | — | 2.9 | 60,280 | 164,310 |

Having thus described the invention in rather full detail, it will be understood that this detail need not be strictly adhered to but that various changes and modifications may suggest themselves to one skilled in the art, all falling within the scope of the present invention as defined by the subjoined claims.

What is claimed is:

1. A metallic glass alloy having a permeability of about 50,000–400,000 at 60 Hz and 0.6 T, magnetostriction ranging from about 8–24 ppm, coercivity ranging from about 0.25–5 A/m, ac core loss ranging from about 1–6 mW/kg at 60 Hz and 0.1 T, exciting power ranging from about 1.1–8 mVA/kg and thermal stability such that first crystallization temperature ranges from about 475°–600° C., said alloy being substantially completely glassy and consisting essentially of about 58 to 81 atom percent iron, about 1 to 10 atom percent of at least one member of the group consisting of nickel and cobalt, about 1 to 6 atom percent of at least one member of the group consisting of chromium, molybdenum, vanadium, niobium, and zirconium, about 11 to 27.5 atom percent boron, about 0.5 to 8 atom percent silicon, 0 to about 2 atom percent carbon, plus incidental impurities, the total of boron, silicon and carbon present ranging from about 17 to 28 atom percent, said alloy having been heat-treated at a temperature and for a time sufficient to achieve stress relief without inducing precipitation of discrete particles therein.

2. As a magnetic core a metallic glass heat-treated as recited in claim 1.

3. A magnetic core as recited in claim 2 having a coercivity less than 1 A/m.

4. A magnetic core as recited in claim 2 having an impedance permeability, measured at a frequency of 60 Hz and at a maximum induction of 0.6 Tesla, of at least 200,000.

5. A magnetic core as recited in claim 4 wherein said impedance permeability is at least about 350,000.

6. A magnetic core as recited in claim 2 having an impedance permeability of at least about 30,000, the maximum and minimum values of said impedance permeability having a ratio not exceeding about 3:1 when measured over a range of magnetic fields applied at 60 Hz, and the maximum and minimum peak amplitudes of said magnetic fields having a ratio of at least about 30:1.

7. A ground fault interrupter comprising the magnetic core recited in claim 2.

8. A current/potential transformer comprising the magnetic core recited in claim 2.

9. An alloy as recited in claim 1, wherein the total of boron, silicon and carbon present ranges from about 17 to 21 atom percent, the total of the elements chromium, molybdenum, vanadium, niobium, and zirconium present ranges from about 1 to 2 atom percent and said alloy having been heat-treated at a temperature of about 340° to 400° C. for a holding time ranging from about 0.25–1 hours.

10. An alloy as recited in claim 1, wherein the total of boron, silicon and carbon present ranges from about 17–21 atom percent, the total of the elements chromium, molybdenum, vanadium, niobium, and zirconium present ranges from about 3 to 6 atom percent and said alloy having been heat treated at a temperature of about 390° to 450° C. for a holding time ranging from about 0.25–2 hours.

11. An alloy as recited in claim 1, wherein the total of boron, silicon and carbon present ranges from about 22 to 28 atom percent and said alloy having been heat treated at a temperature of about 340° to 415° C. for a holding time ranging from about 0.25–2 hours.

12. An alloy as recited in claim 1 consisting essentially of about 68 to 78 atom percent iron, about 2 to 5 atom percent of at least one member selected from the group consisting of nickel and cobalt, about 2 to 5 atom percent of at least one member selected from the group consisting of chromium and molybdenum, about 14 to 19 atom percent boron, about 2 to 5 atom percent silicon, from 0 to 1 atom percent carbon, the total of boron, silicon and carbon present ranging from about 17 to 22 atom percent, said alloy having been heat-treated at a temperature of 380°–415° C. for a period of 0.25–2 hours in the presence of an applied magnetic field.

13. A metallic glass alloy as recited in claim 12 having the composition $Fe_{75.5}Ni_4Mo_3B_{15.5}Si_2$.

14. An alloy as recited in claim 8, wherein said at least one member selected from the group consisting of chromium and molybdenum is present in an amount ranging from about 2 to 4 atom percent.

* * * * *

UNITED STATES PATENT AND TRADEMARK OFFICE

CERTIFICATE OF CORRECTION

PATENT NO. : 4,834,816

DATED : May 30, 1989

INVENTOR(S) : R. Hasegawa and G.E. Fish

It is certified that error appears in the above-identified patent and that said Letters Patent is hereby corrected as shown below:

Column 16, line 32 after "elements" should read --of--.

Column 16, line 50, after "elements" should read --of--.

Signed and Sealed this

Tenth Day of April, 1990

*Attest:*

HARRY F. MANBECK, JR.

*Attesting Officer*

*Commissioner of Patents and Trademarks*